United States Patent [19]

Kobayashi et al.

[11] Patent Number: 4,954,937

[45] Date of Patent: Sep. 4, 1990

[54] LIGHTING LAMP

[75] Inventors: Yasuo Kobayashi; Naoki Hagiwara; Taisuke Hirota; Churyo Kodama; Yasuo Hirasawa; Katsumi Miyazaki; Fumio Kawamura; Takao Higashi, all of Tokyo; Masami Yanagisawa; Akinori Sei, both of Shizuoka, all of Japan

[73] Assignees: Tomoegawa Paper Co., Ltd.; Hitachi Ltd., both of Tokyo, Japan

[21] Appl. No.: 404,657

[22] Filed: Sep. 8, 1989

[30] Foreign Application Priority Data

Sep. 8, 1988 [JP] Japan ..... 63-223615
Sep. 8, 1988 [JP] Japan ..... 63-223616
Jul. 26, 1989 [JP] Japan ..... 1-191390

[51] Int. Cl.[5] ..... F21M 3/14

[52] U.S. Cl. ..... 362/255; 362/260

[58] Field of Search ..... 362/216, 217, 255, 256, 362/293, 260

[56] References Cited

FOREIGN PATENT DOCUMENTS 62-133366 8/1987 Japan .

*Primary Examiner*—Stephen F. Husar
*Attorney, Agent, or Firm*—Cushman, Darby & Cushman

[57] ABSTRACT

A lighting lamp is disclosed, comprising a lamp having laminated on the surface of a bulb thereof a display sheet, said display sheet comprising a support having thereon an active layer containing a pigment which is faded by the action of an active light and an active light-adjusting layer.

14 Claims, 6 Drawing Sheets

LIGHTING LAMP

FIELD OF THE INVENTION

This invention relates to a lighting lamp having laminated thereon a display sheet displaying the life of the lamp.

BACKGROUND OF THE INVENTION

A lighting lamp such as a fluorescent lamp, etc., has a definite lamp life and since a lighting lamp the life of which has been gone must be renewed, it has been desired to detect the lamp life of a lighting lamp before the termination of the life of the lighting lamp for renewing. Hitherto, the lamp life of a lighting lamp is determined by observing the blackened phenomenon at the end portion of the bulb.

Also, it is known to apply an organic material such as a coating material, etc., capable of being discolored or faded by the action of ultraviolet rays to the surface of a bulb of a lighting lamp and determine the lamp life by the extent of the discoloration or the fading as disclosed in JP-A-U-53-14057 and JP-A-U-62-133366. (The term "JP-A-U" as used herein means an "unexamined published Japanese utility model application".)

Now, the blackened phenomenon at the end portion of a bulb of a lighting lamp differs according to the using condition of the lighting lamp and hence it is difficult to accurately determine the lamp life by the blackened phenomenon. Also, when an organic material discoloring or fading by the action of ultraviolet rays is applied to the surface of a bulb of a lighting lamp, the organic material is influenced by the light of other lighting lamps or external light and hence the extent of discoloring or fading changes or the control of the extent of discoloring or fading is not always easy as well as the final state of discoloring or fading is indistinct. Accordingly, there is a problem that the accurate determination of the lamp life is difficult by such a conventional technique.

SUMMARY OF THE INVENTION

The present invention has been made for solving the aforesaid problem in conventional techniques..

The object of this invention is, therefore, to provide a lighting lamp capable of easily and accurately determining the lamp life of a lighting lamp.

As the result of various investigations on a display sheet having an active layer fading by the action of active light such as ultraviolet rays, visible light, etc., the inventors have discovered that the aforesaid object is attained by using a display sheet having a specific layer structure as described below for a lighting lamp and have succeeded in accomplishing the present invention based on the discovery.

That is, according to the 1st embodiment of this invention, there is provided a lighting lamp having a display sheet laminated on the surface of a bulb of the lighting lamp, said display sheet comprising a support having thereon an active layer containing a pigment which is faded by the action of an active light and an active light-adjusting layer.

Also, according to the 2nd embodiment of this invention, there is provided a lighting lamp having a display sheet laminated on the surface of a bulb thereof, said display sheet comprising an active light-adjusting layer having a function as a support and an active layer containing a pigment which is faded by the action of an active light.

In addition, a lighting lamp in this invention means (1) a low-pressure mercury vapor discharging lamp (e.g., a fluorescent lamp), (2) a high-pressure mercury vapor discharging lamp (e.g., a mercury vapor lamp), (3) a high-pressure sodium vapor lamp, (4) a metal vapor discharging lamp (e.g., a metal halide vapor lamp), (5) a discharging lamp on the principle of low-pressure mercury vapor discharging (e.g., a sterilization lamp, a photochemical reaction lamp, a healthy ray lamp, etc.), etc.

DETAILED DESCRIPTION OF THE INVENTION

Then, the lighting lamp of this invention is described by referring to the accompanying drawings.

Figure 1A:
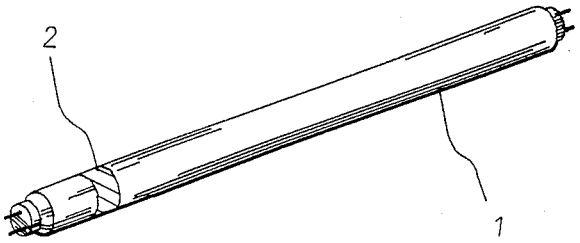
FIG. 1 (*a*), (*b*), and (*c*) are schematic views each showing an example of the lighting lamp of this invention.
Figure 1B:
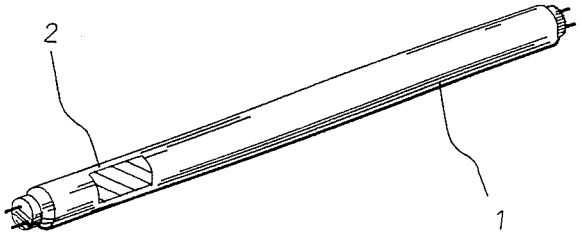
Figure 1C:
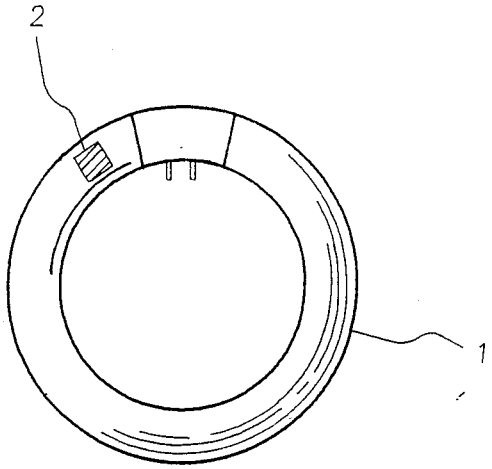

FIG. 1 (*a*), (*b*), and (*c*) are schematic views each showing an example of the lighting lamp of this invention, wherein (*a*) and (*b*) show states each having a display sheet 2 laminated to a portion near the end of a straight tube type bulb 1 and (*c*) shows a state having a display sheet 2 laminated to a portion near a base of an annular bulb 1.

FIG. 2 to FIG. 11 are cross-sectional views each showing a portion of laminating or attaching each display sheet onto the bulb of the lighting lamp of this invention.

Figure 2:
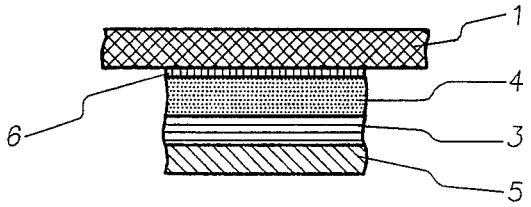
FIG. 2 to FIG. 11 are diagrammatic enlarged cross-sectional views each showing an embodiment of the display sheet for use in this invention.

The display sheet shown in FIG. 2 has a layer structure composed of a support 3 having an active layer 4 on one surface thereof and an active light-adjusting layer 5 on the other surface thereof, and is attached to the surface of a bulb 1 at the surface of the active layer 4 by an adhesive layer 6.

Figure 3:
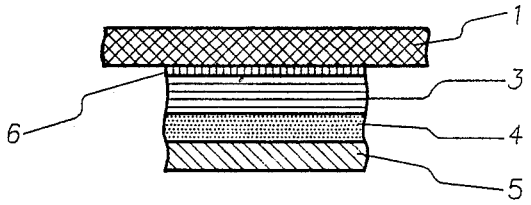

The display sheet shown in FIG. 3 has a layer structure composed of a support 3 having an active layer 4 on one surface thereof and an active light-adjusting layer 5 on the active layer 4, and is attached to the surface of a bulb 1 at the other surface of the support 3 by an adhesive layer 6.

Figure 4:
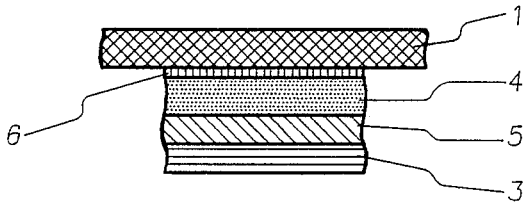

The display sheet shown in FIG. 4 has a layer structure composed of a support 3 having an active light-adjusting layer 5 on one surface thereof and further an active layer 4 on the active light-adjusting layer 5, and is attached to a bulb 1 at the surface of the active layer 4 by an adhesive layer 6.

Figure 5:
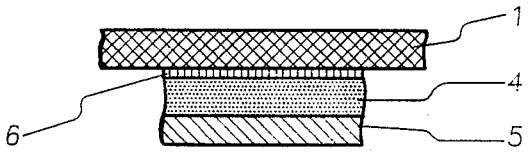

The display sheet shown in FIG. 5 has a layer structure composed of a laminate of an active layer 4 and an active light-adjusting layer 5, and is attached to a bulb 1 at the surface of the active layer 4 by an adhesive layer 6. In this embodiment, the active light-adjusting layer 5 has also a function as a support.

In the display sheets having the layer structures shown in FIG. 2 to FIG. 5, the active light-adjusting layer 5 disposed at the opposite side to the lamp, that is, at an external light entering side, is a layer having a function of adjusting the amount of active lights which are emitted from other lamps than the lighting lamp having the display sheet or from other external light sources and will reach the active layer 4.

The relation of the active layer and the active light-adjusting layer in the embodiments shown in FIG. 2 to FIG. 5 is explained below by FIG. 12.

Figure 12:
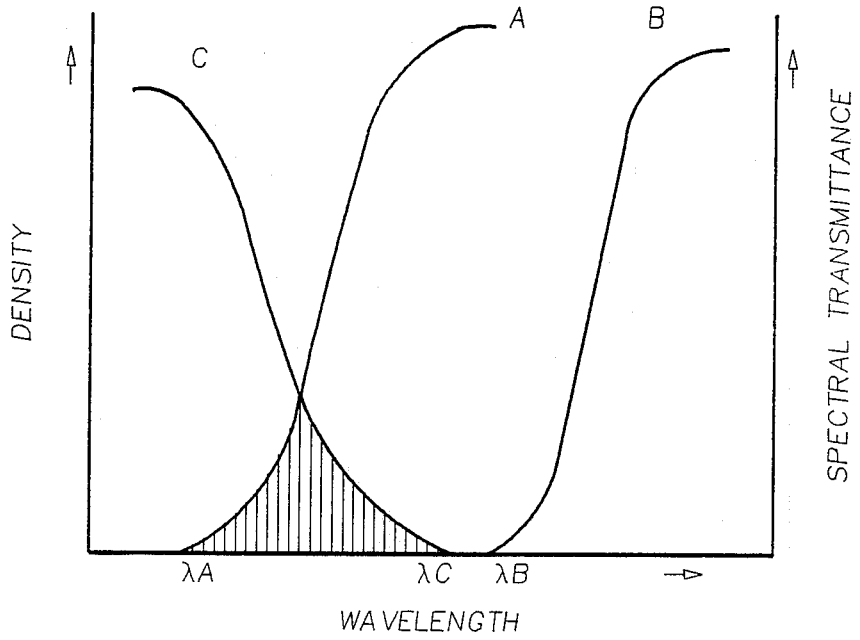
FIG. 12 and FIG. 13 are graphs each showing the relation of wavelength with the spectral transmittance of the active light-adjusting layer and the density change of the active layer in each display sheet.

In FIG. 12, a curve A and a curve B show the spectral transmittances of two active light-adjusting layers each having a different performance and λA and λB each means a wavelength at which the light transmittance of each active light-adjusting layer becomes 0, that is, a cut wavelength. Also, a curve C shown in FIG. 12 shows a working spectrum of the active layer and the working spectrum is the curve formed by plotting the extent of fading of the active layer to each wavelength of an incident light having a definite energy or number or quantity of photons entering the active layer, for example, by plotting the change of density. Also, λC means a long wavelength end of an active light causing a fading change of the active layer.

In FIG. 12, the overlapped portion (shaded portion) of the domain surrounded by the curve A and the domain surrounded by the curve C shows an active light in external lights acting to the active layer by passing through the active light-adjusting layer. If the area of the portion is larger, that is, the cut wavelength λA of the active light-adjusting layer shifts to a shorter wavelength side, the influence of an external light acting to the active layer becomes larger. Accordingly, for reducing the influence of an external light acting to the active layer, the active light-adjusting layer having a spectral transmittance having the cut wavelength λA which is at a longer wavelength side than λC may be employed. In this invention, the active light-adjusting layer shown, for example, by the curve B in FIG. 12 is used.

Figure 6:
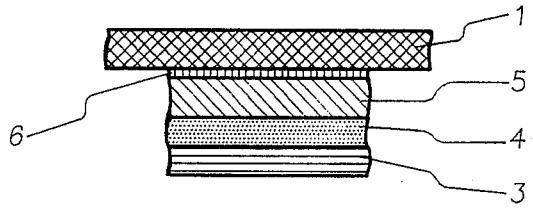

Also, the display sheet shown in FIG. 6 has a layer structure composed of a support 3 having an active layer 4 thereon and an active light-adjusting layer 5 on the active layer 4, and is attached to a bulb 1 at the surface of the active light-adjusting layer 5 by an adhesive layer 6.

Figure 7:
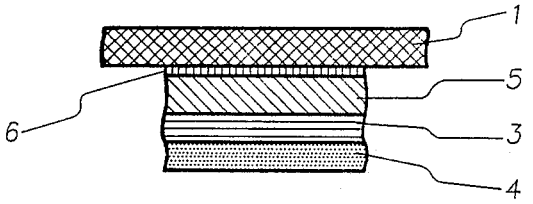

The display sheet shown in FIG. 7 has a layer structure composed of a support 3 having an active layer 4 on one surface thereof and an active light-adjusting layer 5 on the other surface thereof, and is attached to a bulb 1 at the surface of the active light-adjusting layer 5 by an adhesive layer 6.

Figure 8:
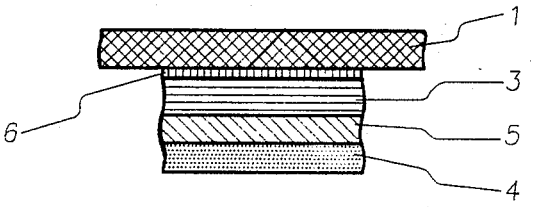

The display sheet shown in FIG. 8 has a layer structure composed of a support 3 having an active light-adjusting layer 5 on one surface thereof and an active layer 4 on the active light-adjusting layer 5, and is attached to a bulb 1 at the other surface of the support 3 by an adhesive layer 6.

Figure 9:
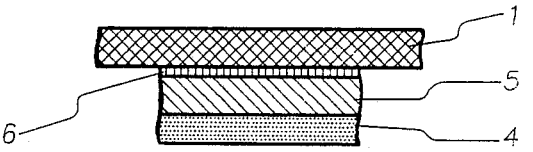

Also, the display sheet shown in FIG. 9 has a layer structure composed of a laminate of an active layer 4 and an active light-adjusting layer 5, and is attached to a bulb 1 at the surface of the active light-adjusing layer 5 by an adhesive layer 6. In this embodiment, the active light-adjusting layer 5 also has a function as a support.

In the display sheets having the layer structures shown in FIG. 6 to FIG. 9, the active light-adjusting layer 5 disposed at the lamp side, that is, at the side being attached to the bulb 1, has a function of adjusting the amount of the active light which is emitted from the lighting lamp having the display sheet laminated thereon and will reach the active layer 4.

Figure 13:
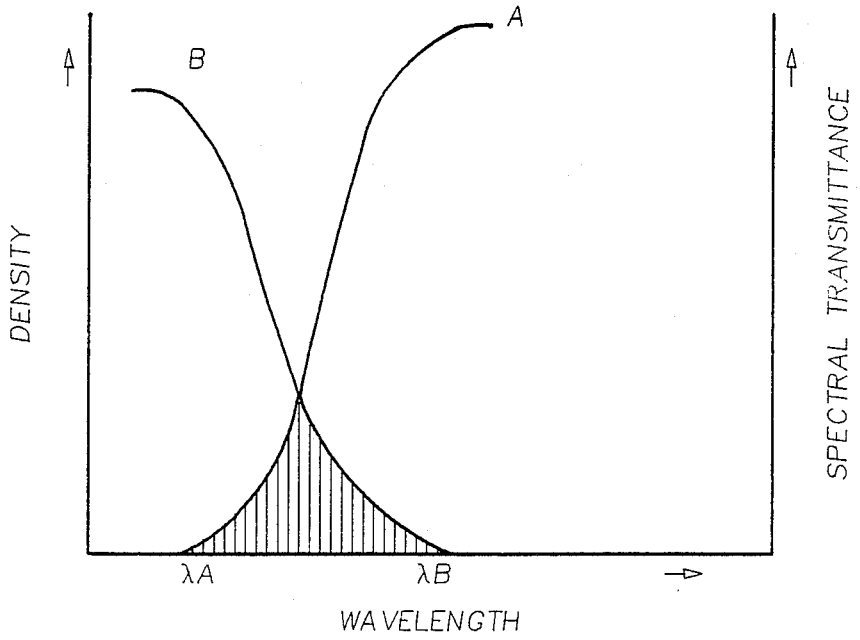

The relation of the active layer and the active light-adjusting layer in the embodiments shown in FIG. 6 to FIG. 9 is explained by FIG. 13.

In FIG. 13, a curve A shows the spectral transmittance and λA means a wavelength at which the light transmittance of the active light-adjusting layer becomes 0, that is, a cut wavelength. Also, a curve B shows the working spectrum of the active layer and the working spectrum is the curve formed by plotting the extent of fading of the active layer to each wavelength of an incident light having a definite energy or number or quantity of photons entering the active layer, for example, by plotting the change of density. Also, λB means a long wavelength end of an active light causing a fading change of the active layer.

In FIG. 13, the overlapped portion (shaded portion) of the domain surrounded by the curve A and the domain surrounded by the curve B shows an active light acting to the active layer by passing through the active light-adjusting layer 5 disposed at the lamp side. If the area of the shaded portion is larger, that is, the cut wavelength λA of the active light-adjusting layer 5 is shifted to a shorter wavelength side, the amount of the active light reaching the active layer becomes larger. Thus, the fading rate of the active layer can be adjusted by selecting the cut wavelength of the active light-adjusting layer 5 disposed at the lamp side.

Figure 10:
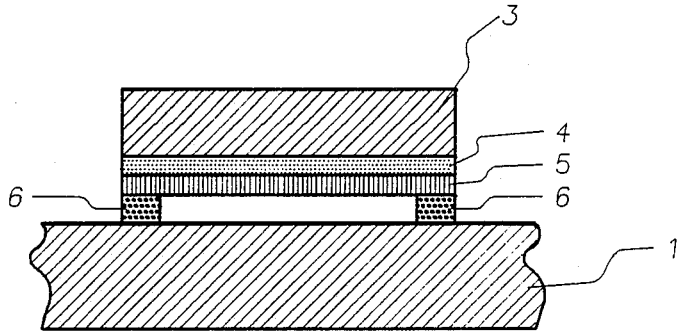
Figure 11:
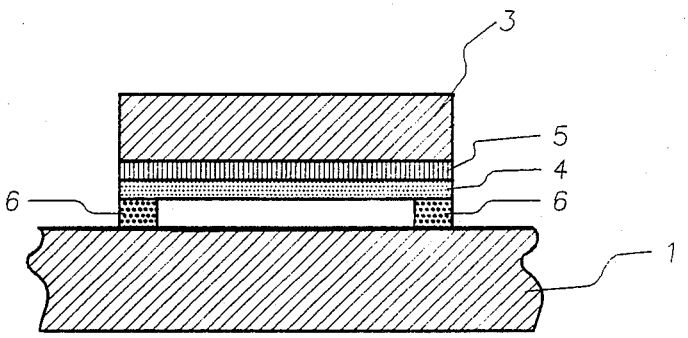

Also, in the display sheets shown in FIG. 10 and FIG. 11, an adhesive layer 6 is formed on the surface of the display sheet such that the portion corresponding to at least the display portion is exposed and the display sheet is attached to the surface of a bulb by the adhesive layer.

The display sheet shown in FIG. 10 has a layer structure that an active layer 4 and an active light-adjusting layer 5 are successively formed on a support 3 at the side of a bulb 1 and the aforesaid adhesive layer 6 is formed on the active light-adjusting layer 5.

Also, the display sheet shown in FIG. 11 has a layer structure that an active light-adjusting layer 5 and an active layer 4 are successively formed on a support 3 at the side of a bulb 1 and the aforesaid adhesive layer 6 is formed on the active layer 4.

In the display sheets having the layer structures shown in FIG. 10 and FIG. 11, the adhesive layer is formed on the surface of the display sheet such that the portion corresponding to at least the display portion as described above and in this case, the adhesive layer may be formed in any form if the portion forming the display portion is in an exposed portion without being covered by the adhesive layer.

In the display sheet of this embodiment, there exists a portion without being covered by the adhesive layer and hence a hollow space is formed between the aforesaid portion and the lamp body, whereby oxygen can be supplied to the active layer. Accordingly, the fading or discoloring rate at the display portion in the display sheet is stabilized as well as unevenness of color does not occur and thus the life of the lighting lamp can be more easily determined.

Then, the constitution of each layer of the display sheet of this invention is explained below.

The active layer in this invention is composed of a layer containing a pigment fading from an initial hue to colorless by the action of an active light such as ultraviolet rays, visible light, etc. As such pigments, there are conventionally known various pigments such as monoazo pigments, disazo pigments, diphenylmethane pigments, triphenylmethane pigments, quinone pigments, metal complex salt pigments, etc.

Then, specific examples of these pigments are shown below.

As the pigment fading from yellow to colorless, there are Hansa Yellow 10G, Hansa Yellow 13G, Hansa Yellow 5G, Diarylide Yellow (AAA), Diarylide Yellow (AAMX), Diarylide Yellow (AAOT), Yellow 5G, Diarylide Yellow (AAOA), HR Yellow, Tartrazine Yellow, etc.; as the pigment fading from orange to colorless, there are Benzidine Orange, Orthonitroaniline Orange, Crayon Orange, Dianisidine Orange, Persian Orange, Permanent Orange RL, etc.; as the pigment fading from red to colorless, there are Para Red, Pyrazolone Red, Dianisidine Red, Lithol Red 2G, Lake Red C, Helio Bordeaux BL, Lithol Rubine B, Rubine G Toner, BON Maroon, Bronze Red, etc.; as the pigment fading from blue to colorless, there are Alkali Blue, Peacock Blue Lake, Dianisidine Blue, Reflex Blue R, etc.; as the pigment fading from green to colorless, there are Pigment Green B, Brilliant Green Lake, etc.; and as the pigment fading from violet to colorless, there are Wool Violet 5BN Lake, Rhodamine B Lake, Methyl Violet Lake, etc.

These pigments may be used as a combination of two or more kinds thereof for one display sheet, whereby the extent of the progress of the lighting time of the lamp can be displayed.

In the case of the display sheets having the layer structures shown in FIG. 2 to FIG. 11, the active layer is formed by dispersing and dissolving the aforesaid pigment(s) in a solvent together with a high molecular weight binder having a film-forming property to provide a coating composition and coating the composition on a support in the case of the display sheets shown in FIG. 2, FIG. 3, FIG. 6, FIG. 7, and FIG. 10 or on the active light-adjusting layer in the case of the display sheets shown in FIG. 4 and FIG. 11.

Examples of the aforesaid high molecular weight binder are cellulose derivatives such as ethyl cellulose, acetyl cellulose, hydroxypropyl cellulose, nitrocellulose, cellulose acetate butyrate, cellulose acetate propionate, etc.; polyvinyl chloride; vinyl chloride copolymers such as a vinyl chloride-vinyl acetate copolymer, a vinyl chloride-vinyl acetate-vinyl alcohol copolymer, etc.; ethylene copolymers such as an ethylene-vinyl acetate copolymer, an ethylene-vinyl alcohol copolymer, an ethylene-vinyl chloride copolymer, etc.; polystyrene; styrene copolymers such as a styrene-butadiene-acrylonitrile copolymer, a styrene-butadiene copolymers, etc.; an acrylonitrile-butadiene copolymer; acrylic resins such as polyacrylic acid esters, polymethacrylic acid esters, copolymers thereof, etc.; coating composition resins such as a butyral resin, an epoxy resin, an alkyd resin, a phenol resin, a saturated polyester, a fluoropolymer resin, etc.; and engineering plastics such as polycarbonate, polyarylate, polysulfone, polyether sulfone, aromatic polyester, polyphenylene ether, an acrylonitrile-chlorinated polyethylene-styrene copolymer, etc.

Examples of the solvent which is used for dissolving the pigment are water, methanol, ethanol, isopropanol, benzene, toluene, xylene, ethyl acetate, isobutyl acetate, acetone, 2-butanone, 4-methyl-2-pentanone, cyclohexanone, tetrahydrofuran, dioxane, methylene chloride, chloroform, 1,2-dichloroethane, 1,1,1-trichloroethane, chlorobenzene, hexane, heptane, cyclohexane, dimethylamide, and dimethyl sulfoxide.

There is no particular restriction on the ratio of the amounts of the components constituting the active layer but a preferred example is as follows.

| | |
|---|---|
| Fading Pigment | 10 parts by weight |
| High Molecular Weight Binder | 1 to 1000 by weight |

Also, the thickness of the active layer is from 0.1 to 100 μm, and preferably from 0.5 to 50 μm.

In this invention, a transparent or translucent sheet-form support is used for the support. Examples of such a support are cellophane films, polyester films, cellulose triacetate films, polycarbonate films, fluoropolymer resin films, polyethylene films, polypropylene films, polyarylate films, TPX films, etc.

As the active light-adjusting layer of the display sheet in this invention, a layer having a composition having an absorptive property for an active light can be used.

For example, for a composition having an absorptive property for the wavelength region of an active light of not longer than 450 n.m., conventionally know ultraviolet light absorptive materials can be used. Examples thereof are benzotriazole series compounds, benzophenone series compounds, salicylate series compounds, cyanoacrylate series compounds, and oxalic acid anilide series compounds. Furthermore, as the material having the absorptive property for the aforesaid wavelength region, fine particles of an inorganic material such as zinc oxide, titanium oxide, tin oxide, bismuth oxide, tungsten oxide, barium titanate, etc., can be also used.

Also, by suitably selecting the composition of the active layer, the active layer showing activity for a visible light having wavelengths of longer than about 450 n.m. can be formed. In such a case, various kinds of dyes, pigments, etc., absorbing the active light can be used.

Specific examples of the ultraviolet light absorbent which can be used for the active light-adjusting layer in this invention are 2-(2-hydroxy-5-methylphenyl)benzotriazole, 2-(3-t-butyl-5-methyl-2-hydroxyphenyl)-5-chlorobenzotriazole, 2-(3,5-di-t-butyl-2-hydroxyphenyl)benzotriazole, 2-(3,5-di-t-pentyl-2-hydroxyphenyl)benzotriazole, 2,4-dihydroxybenzophenone, 2-hydroxy-4-methoxybenzophenone, 2,2'-dihydroxy-4,4'-dimethoxybenzophenone, 2,2',4,4'-tertahydroxybenzophenone, phenyl salicylate, 4-t-butylphenyl salicylate, ethyl-2-cyano-3,3-diphenyl acrylate, 2-ethylhexyl-2-cyano-3,3-diphenyl acrylate, 2-ethoxy-2'-ethyloxalic acid bisanilide, 2-ethoxy-5-t-butyl-2'-ethyloxalic acid bisanilide, etc.

In the case of the display sheets having the layer structures shown in FIG. 2 to FIG. 11, the active light-adjusting layer is formed by dispersing and dissolving the aforesaid active light absorbing material in a solvent together with a high molecular weight binder having a film-forming property to provide a coating composition and coating the coating composition on a support in the cases shown in FIG. 2, FIG. 4, FIG. 7, FIG. 8, and FIG. 11 or on the active layer in the cases shown in FIG. 3, FIG. 6, and FIG. 10.

Examples of the aforesaid high molecular weight binder are cellulose derivatives such as ethyl cellulose, hydroxypropyl cellulose, nitrocellulose, cellulose acetate butyrate, cellulose acetate propionate, etc.; polyvinyl chloride; vinyl chloride copolymers such as a vinyl chloride-vinyl acetate copolymer, a vinyl chloride-acrylic acid copolymer, etc.; ethylene copolymers such as an ethylene-vinyl acetate copolymer, an ethylene-vinyl alcohol copolymer, an ethylene-vinyl chloride copolymer, etc.; polystyrene; styrene copolymers such as a styrene-butadiene copolymer, a styrene-acrylonitrile copolymer, etc.; acrylic resins such as polyacrylic acid esters, polymethacrylic acid esters, copolymers thereof, etc.; coating composition resins such as epoxy resins, alkyd resins, phenol resins, saturated polyester resins, fluoropolymer resins, etc.; and engineering plastics such as polycarbonate, polyarylate, polysulfone, polyether sulfone, aromatic polyester, polyphenylene ether, an acrylonitrile-chlorinated polyethylene-styrene copolymer, etc.

Examples of the solvent which is used for preparing the coating composition are water, methanol, ethanol, isopropanol, benzene, toluene, xylene, ethyl acetate, isobutyl acetate, acetone, 2-butanone, 4-methyl-2-pentanone, cyclohexanone, tetrahydrofuran, dioxane, methylene chloride, chloroform 1,2-dichloroethane, 1,1,1-trichloroethane, chlorobenzene, hexane, heptane, cyclohexane, dimethylacetamide, and dimethyl sulfoxide.

Also, as the ratio of the active light absorbing material and the high molecular weight binder in the active light-adjusting layer in this invention, it is proper that the proportion of the binder is from 0.1 to 1000 parts by weight to one part by weight of the active light-absorbing material. The thickness of the active light-adjusting layer is from 0.1 to 100 μm, and preferably from 0.5 to 50 μm.

The adhesive layer being formed on the display sheet is formed by coating a coating composition composed of at least one kind of adhesives such as natural rubber series, SBR series, acrylic series, butyl rubber series, thermoplastic elastomer series, silicone series, vinyl acetate series, vinyl chloride series, epoxy series, polyamide series, EVA series, urethane series, denatured acrylic series, acrylate-vinyl acetate series, etc. The thickness of the adhesive layer is from 1 to 100 μm, and preferably from 5 to 30 μm.

The adhesive layer may be formed in any desired form if the portion forming the display portion of the display sheet is in an exposed state.

Also, in the display sheets having the layer structures shown in FIG. 5 and FIG. 9, it is necessary that the active light-adjusting layer has a function as a support and as such an active light-adjusting layer, there are, for example, polyester films and polycarbonate films containing an active light absorbent, polyester films colored by a dye, colored and transparent polyimide films, polyamide-imide films, and polyphenylene sulfide films, and also polyester films having a thin layer of a metal such as aluminum, tin, indium, etc., or a metal oxide such as zinc oxide, titanium oxide, indium oxide, tin oxide, bismuth oxide, etc., formed by vacuum vapor deposition or sputtering.

The aforesaid display sheet is cut into a desired size and laminated on or attached to a desired position of the surface of the bulb of a lighting lamp using the adhesive layer, whereby a lighting lamp capable of displaying the lamp life can be obtained.

Since the life time of a lamp differs according to the kind of lamp, it is necessary to control the discoloring or fading time of the display sheet for adapting to each lamp. In this case, as shown in the following examples, the kind of the pigment is changed as well as the composition of the active layer, the thickness of the layer, the composition of the active light-adjusting layer, the thickness of the layer, the kind of the ultraviolet light absorber, etc., may be changed. Also, by setting the display time so that the display sheet is faded faster than the life time of the lamp, a customer can know the approach of the time for renewing the lamp.

Furthermore, in the lighting lamp of this invention, two or more kinds of different display sheets may be laminated on one lamp as a combination, whereby the extent of the progress of the lighting time of the lamp can be displayed.

Then, the invention is further explained in more detail by the following examples, wherein "parts" and "%" are all by weight.

EXAMPLE 1

A coating composition for active layer having following composition (I) was prepared.

Composition (I):

| | |
|---|---|
| HR Yellow | 10 parts |
| Toluene/2-butanone (1/1) Solution of 5% Saturated Polyester | 100 parts |

The aforesaid coating composition was coated on a polyester film of 50 μm in thickness to form an active layer having a thickness of 5 μm.

Then, a coating composition for active light-adjusting layer having following composition (II) was prepared.

Composition (II):

| | |
|---|---|
| 2,4-Dihydroxybenzophenone | 10 parts |
| Toluene/2-butanone (1/1) Solution of 10% Saturated Polyester | 100 parts |

The coating composition having the above composition was coated on the aforesaid polyester film at the opposite side to the active layer-carrying side to form an active light-adjusting layer having a thickness of 5 μm. Thus, a display sheet was prepared. The display sheet was a film laminate having a bright yellow hue.

Then, an adhesive layer was formed on the active layer of the display sheet and the sheet was attached to the surface of a lamp bulb of a lighting device equipped with two straight tube fluorescent lamps FL-40SS-EX/37-G.

As the result of performing the lighting test of the lighting lamp thus obtained, the color of the display sheet became faint with the passage of the lighting time and by the lighting time of longer than 12,000 hours, the display sheet was completely faded and became colorless and transparent. The life of the lighting lamp was 12,000 hours and hence the life could be displayed by the display sheet.

EXAMPLE 2

A coating composition for active layer having following composition (III) was prepared.

Composition (III):

| | |
|---|---|
| Diarylide Yellow (AAA) | 10 parts |
| Toluene Solution of 5% Methacrylic Acid Ester Copolymer | 200 parts |

The aforesaid coating composition was coated on a polyester film of 38 μm in thickness to form an active layer having a thickness of 5 μm.

A coating composition for active light-adjusting layer having following composition (IV) was prepared.
Composition (IV):

| | |
|---|---|
| 2,2'-Dihydroxy-4,4'-dimethoxybenzophenone | 10 parts |
| Toluene Solution of 5% Methacrylic Acid Ester Copolymer | 200 parts |

The coating composition having the above composition was coated on the aforesaid polyester film at the opposite side to the active layer-carrying side to form an active light-adjusting layer having a thickness of 5 μm.

Thus, a display sheet was prepared. The display sheet was a film laminate having a yellow hue.

Then, an adhesive layer was formed on the active layer of the display sheet and the sheet was attached to the surface of a lamp bulb (FCL-30EX-D/28G) of a lighting device equipped with annular fluorescent lamps FCL-30EX-D/28G and FCL-32EX-D/30G.

As the result of performing the lighting test for the lighting lamp thus obtained, the color of the display sheet became faint with the lighting time and by the lighting time of longer than 6,000 hours, the display sheet was completely faded and became colorless and transparent. The life of the lighting lamp was 6,000 hours and thus the life of the lamp could be displayed by the display sheet.

EXAMPLE 3

A coating composition for active layer having following composition (V) was prepared.
Composition (V):

| | |
|---|---|
| Lithol Rubine B | 10 parts |
| Toluene Solution of 10% Styrene-butadiene-acrylonitrile Copolymer | 100 parts |

The aforesaid coating composition was coated on a ultraviolet light-absorptive polyester film (made by Toyobo Co., Ltd.) of 50 μm in thickness to provide a display sheet. The display sheet was a film having a red hue.

Then, an adhesive layer was formed on the active layer of the display sheet and the sheet was attached to the surface of a lamp bulb of a lighting device equipped with a straight tube fluorescent lamp FL-20SSW-F/18-G.

As the result of performing the lighting test for the lighting lamp thus obtained, the color of the display sheet became faint with the lighting time and by the lighting time of longer than 8,500 hours, the sheet was completely faded and became colorless and transparent. The life of the lighting lamp was 8,500 hours and thus the life of the lamp could be displayed by the display sheet.

EXAMPLE 4

A coating composition for active layer having following composition (VI) and a coating composition for active light-adjusting layer having following composition (VII) were prepared.
Composition (VI):

| | |
|---|---|
| Benzidine Orange | 10 parts |

-continued

| | |
|---|---|
| Tetrahydrofuran Solution of 5% Polycarbonate | 200 parts |

Composition (VII):

| | |
|---|---|
| 2-(3,5-Di-t-butyl-2-hydroxyphenyl)benzotriazole | 10 parts |
| Tetrahydrofuran Solution of 5% Polycarbonate | 200 parts |

Each of the aforesaid coating compositions was coated on each side of a polyester film of 50 μm in thickness to form each layer (i.e., an active layer or an active light-adjusting layer) having a thickness of 10 μm. Thus, a display sheet was prepared.

The display sheet was a film laminate having an orange hue.

Then, an adhesive layer was formed on the active layer of the display sheet and then sheet was attached to the surface of a lamp bulb of a printing plate making machine equipped with 8 copying fluorescent lamps (FL40BA-42).

As the result of performing an actual lighting test for the lamp thus obtained, the color of the display sheet became faint with the lighting time and by the lighting time of longer than 5,000 hours, the sheet was completely faded and became colorless and transparent. The life of the lighting lamp was 5,000 hours and thus the life of the lamp could be displayed by the display sheet.

EXAMPLES 5 TO 10

By following the same procedure as Example 1 except that each of the pigments in Table 1 below was used in place of HR Yellow in the composition (I) and each of the ultraviolet light absorbers shown in Table 1 was used in place of 2,4-dihydroxybenzophenone in the composition (II), each of display sheets was prepared. These display sheets were film laminates having the hues shown in Table 1.

TABLE 1

| Example | Pigment | Ultraviolet Light Absorbent | Hue of Sheet |
|---|---|---|---|
| 5 | Diarylide Yellow (AAOA) | 2-(2-Hydroxy-5-methylphenyl)benzotriazole | Yellow |
| 6 | Dianisidine Orange | 2-(2-Hydroxy-5-methylphenyl)benzotriazole | Orange |
| 7 | Lake Red C | 2,2'-Dihydroxy-4,4'-dimethoxybenzophenone | Red |
| 8 | Methyl Violet Lake | 2,2'-Dihydroxy-4,4'-dimethoxybenzophenone | Violet |
| 9 | Dianisidine Blue | 2-(3,5-Di-t-butyl-5-methyl-2-hydroxyphenyl)-5-chlorobenzotriazole | Blue |
| 10 | Pigment Green B | 2,2',4,4'-Tetrahydroxybenzophenone | Green |

Then, by following the same procedure as in Example 1 using each of the display sheets, each of lighting lamps was obtained. On the lighting lamps obtained, the lighting test was performed by the same manner as Example 1. The results showed that these display sheets all became faint with the lighting time and by the lighting time of longer than 12,000 hours, the sheets were completely faded and became colorless and transparent. The life of 40 Watt straight tube type fluorescent lamp was 12,000 hours and thus the lamp life could be displayed by using these display sheets.

COMPARISON EXAMPLES 1 TO 4

By following the same procedures as Examples 1 to 4 except that the active light-adjusting layer was not formed in each display sheet, display sheets were prepared (Comparison Examples 1 to 4). In this case, however, in Comparison Example 3, the coating composition for active layer having the composition (V) was coated on a polyester film of 50 μm in thickness at a thickness of 5 μm.

On the comparison display sheets thus prepared, the lighting test was performed according to the manners in Examples 1 to 4. The lighting times required for completely fading the display sheets to make colorless and transparent are shown in Table 2.

TABLE 2

| Comparison Example | Lighting Time (hour) |
|---|---|
| 1 | 10,000 |
| 2 | 5,000 |
| 3 | 7,000 |
| 4 | 3,000 |

In the comparison examples, fading of each of the display sheets was accelerated by the influence of external light, which results in displaying of each display sheet faster than the life of the lamp.

EXAMPLE 11

A coating composition for active layer having following composition (VIII) was prepared.

Composition (VIII):

| | |
|---|---|
| Lake Red C | 10 parts |
| 2-Butanone Solution of 10% Polyvinyl butyral | 100 parts |

The aforesaid coating composition was coated on a polyester film of 50 μm in thickness to form an active layer having a thickness of 5 μm.

Then, a coating composition for active light-adjusting layer having following composition (IX) was prepared.

Composition (IX):

| | |
|---|---|
| 4-t-Butylphenyl Salicylate | 10 parts |
| 2-Butanone Solution of 10% Polyvinyl butyral | 100 parts |

The coating composition having the aforesaid composition was coated on the active layer to form an active light-adjusting layer having a thickness of 5 μm.

Thus, a display sheet was prepared. The display sheet was a film laminate having a red hue.

Then, an adhesive layer was formed on the active light-adjusting layer of the display sheet and the sheet was attached to the surface of a lamp bulb of a straight tube type fluorescent lamp FL-20SS-EXD/18-G to provide a lighting lamp.

As the result of performing the lighting test for the lighting lamp, the color of the display sheet became faint with the lighting time and by the lighting time of longer than 8,500 hours, the sheet was completely faded and became colorless and transparent. The life of the lighting lamp was 8,500 hours and hence the life of the lamp could be displayed by the display sheet.

EXAMPLE 12

A coating composition for active layer having following composition (X) was prepared.

Composition (X):

| | |
|---|---|
| HR Yellow | 10 parts |
| Toluene/2-butanone (2/1) Solution of 5% Saturated Polyester | 200 parts |

The aforesaid coating composition was coated on a polyester film of 50 μm in thickness to form an active layer having a thickness of 5 μm.

Then, a coating composition for active light-adjusting layer having following composition (XI) was prepared.

Composition (XI):

| | |
|---|---|
| 1-(2-Hydroxy-5-methylphenyl)-benzotriazole | 10 parts |
| Toluene/2-butanone (2/1) Solution of 5% Saturated Polyester | 200 parts |

The coating composition having the aforesaid composition was coated on the aforesaid active layer to form an active light-adjusting layer having a thickness of 5 μm to provide a display sheet. The display sheet was a film laminate having a bright yellow hue.

Then, an adhesive layer was formed on the active light-adjusting layer of the display sheet and attached to the surface of a lamp bulb of a lighting device equipped with two straight tube type fluorescent lamps FL-40SS-EX-N/37-G.

As the result of performing the lighting test for the lighting lamp, the color of the display sheet became faint with the lighting time and by the lighting time of longer than 12,000 hours, the sheet was completely faded and became colorless and transparent. The life of the lighting lamp was 12,000 hours and hence the life of the lamp could be displayed by the display sheet.

EXAMPLE 13

A coating composition for active layer having following composition (XII) was prepared.

Composition (XII):

| | |
|---|---|
| Dianisidine Orange | 10 parts |
| Toluene Solution of 5% Methacrylic Acid Ester Copolymer | 200 parts |

The aforesaid coating composition was coated on a ultraviolet light-absorptive polyester film (made by Toyobo Co., Ltd.) of 50 μm in thickness at a thickness of 8 μm to provide a display sheet. The display sheet was a film having an orange hue.

Then, an adhesive layer was formed on the polyester film at the opposite side to the active layer-carrying side and the display sheet was attached to the surface of a lamp bulb (FCL-30EX-D/28G) of a lighting device equipped with annular fluorescent lamps (FCL-30EX-D/28G and FCL-32EX-D/30G).

As the result of performing the lighting test for the lighting lamp, the color of the display sheet became faint with the lighting time and by the lighting time of longer than 6,000 hours, the sheet was completely faded and became colorless and transparent. The life of the lighting lamp was 6,000 hours and thus the life of the lamp could be displayed by the display sheet.

EXAMPLE 14

A coating composition for active layer having following composition (XIII) and a coating composition for active light-adjusting layer having following composition (XIV) were prepared.

Composition (XIII):

| | |
|---|---|
| Hansa Yellow 10G | 10 parts |
| Toluene Solution of 10% Styrene-Butadiene-Acrylonitrile Copolymer | 100 parts |

Composition (XIV):

| | |
|---|---|
| Ethyl-2-cyano-3,3-diphenyl acrylate | 10 parts |
| Toluene Solution of 10% Styrene-Butadiene-Acrylonitrile Copolymer | 100 parts |

The aforesaid coating composition for active layer was coated on a polyester film of 50 μm in thickness to form an active layer having a thickness of 5 μm and then the aforesaid coating composition for active light-adjusting layer was coated on the active layer at a thickness of 5 μm to form an active light-adjusting layer. Thus, a display sheet was prepared. The display sheet was a film laminate having a yellow hue.

Then, an adhesive layer was formed on the active layer of the display sheet and the sheet was attached to the surface of a lamp bulb of a lighting device equipped with two straight tube type fluorescent lamps (FL-40SD-SDL-G).

As the result of performing the lighting test for the lighting lamp thus obtained, the color of the display sheet became faint with the lighting time and by the lighting time of longer than 12,000 hours, the sheet was completely faded and became colorless and transparent. The life of the lighting lamp was 12,000 hours and thus the life of the lamp could be displayed by the display sheet.

EXAMPLES 15 TO 20

By following the same procedure as Example 11 except that each of the pigments shown in Table 2 below was used in place of Lake Red C in the composition (VIII) of Example 11 and each of the ultraviolet light absorbents shown in Table 2 was used in place of 4-t-butylphenyl salicylate in the composition (IX), each of display sheets was prepared. These display sheets were film laminates having the hues shown in Table 3.

TABLE 2

| Example | Pigment | Ultraviolet Light Absorbent | Hue of Sheet |
|---|---|---|---|
| 15 | Diarylide Yellow (AAA) | 2,4-Dihydroxybenzophenone | Yellow |
| 16 | Dianisidine Orange | 2,2',4,4'-Tetrahydroxybenzophenone | Orange |
| 17 | Lithol Rubine B | 2,2',4,4'-Tetrahydroxybenzophenone | Red |
| 18 | Reflex Blue | 2,2'-Dihydroxy-4,4'-dimethoxybenzophenone | Blue |
| 19 | Brilliant Green Lake | 2-(3-t-Butyl-5-methyl-2-hydroxyphenyl)-5-chlorobenzotriazole | Green |

TABLE 2-continued

| Example | Pigment | Ultraviolet Light Absorbent | Hue of Sheet |
|---|---|---|---|
| 20 | Wool Violet 5BN Lake | 2-(3-t-Butyl-5-methyl-2-hydroxyphenyl)-5-chlorobenzotriazole | Violet |

Then, by following the same procedure as in Example 11 using each of these display sheets, lighting lamps were prepared. On each lamp thus obtained, the lighting test was performed by the same manner as Example 11. The results showed that the colors of the display sheets became faint with the lighting time and by the lighting time of longer than 8,5000 hours, the display sheets were all completely faded and became colorless and transparent. The life of the lighting lamp was 8,500 hours and thus the life of the lamp could be displayed by these display sheets.

EXAMPLE 21

A coating composition for forming an active light-adjusting layer having the composition shown below was coated on a transparent polyester film support of 50 μm in thickness to form an active light-adjusting layer having a thickness of 5 μm.

Coating Composition for Active Light-Adjusting Layer:

| | |
|---|---|
| 2-(3,5-Di-t-pentyl-2-hydroxyphenyl)benzotriazole | 3 parts |
| Toluene Solution of 10% Polymethyl Methacrylate | 100 parts |

Then, a coating composition for forming an active layer having the composition shown below was coated on the active light-adjusting layer to form an active layer of 4 μm in thickness composed of an azoic yellow pigment and a high molecular weight binder.

Coating Composition for Active Layer:

| | |
|---|---|
| Azoic Yellow Pigment (Hansa Yellow) | 1 part |
| Polyester Series Binder (Vylon ® 200, trade name, made by Toyobo Co., Ltd.) | 1 part |
| Toluene | 10 parts |
| Methyl Ethyl Ketone | 10 parts |

Furthermore, a coating composition for forming an adhesive layer having the composition shown below was formed on the active layer at two marginal portions to form an adhesive layer having a thickness of 15 μm. Thus, a display sheet having the layer structure shown in FIG. 11 was prepared.

Coating Composition for Adhesive Layer:

| | |
|---|---|
| Acrylic Adhesive (Oribine ® BPS1109, trade name, made by Toyo Ink Manufacturing Co., Ltd.) (40% Toluene Solution) | 100 parts |
| Isocyanate Series Hardening Agent (HBS8515, trade name, made by Toyo Ink Manufacturing Co., Ltd.) | 1 part |
| Ethyl Acetate | 10 parts |

The display sheet thus prepared was attached to the surface of each bulb of a straight tube type fluorescent lamp FL40SS.EX-N/37 and an annular fluorescent lamp FCL30EX-D/28 as shown in FIG. 1 (*b*) and (*c*) to provide lighting lamps.

When a lighting test was performed on the lighting lamps and also comparison lighting lamps having no active light-adjusting layer in the display sheet, it was confirmed that the lighting lamps using the display sheet having the active light-adjusting layer showed good reproducibility of fading time and hence by the existence of the active light-adjusting layer, fading of the display sheet by external light could be prevented.

EXAMPLE 22

By following the same procedure as Example 21 except that the active layer having the same composition as in Example 21 was formed on the support and the active light-adjusting layer having the same composition as in Example 21 was formed between the active layer and the adhesive layer, a display sheet having the layer structure shown in FIG. 10 was prepared and lighting lamps were prepared as in Example 21 using the display sheet.

When a lighting test was performed on the lighting lamps and comparison lighting lamps using a display sheet having no active light-adjusting layer, it was confirmed that the display lamps of this invention showed a longer fading time than the comparison lighting lamps. Accordingly, it can be seen that the fading time can be adjusted by forming the active light-adjusting layer.

As the described above, since the lighting lamp of this invention has laminated thereon the display sheet having the aforesaid layer structure, the fading state of the display sheet is not influenced by other lighting lamps or other external lights. Accordingly, by observing the fading state of the display sheet laminated on the lighting lamp, the life of the lamp can be easily and accurately determined. Also, by suitably selecting the cut wavelength of the active light-adjusting layer, the fading rate of the active layer can be desirably selected. Accordingly, since the display sheet can be selected according to the life of a lamp, the lamp life can be accurately determined.

Furthermore, by suitably selecting the components constituting the display sheet, a display sheet adapting to the life of the lighting lamp according to the use thereof can be prepared and further, the display sheet for use in this invention can freely select the hue, the invention can be applied to lighting lamps corresponding to various used.

Also, in the case of forming a hollow space between the lamp surface and the laminate sheet through adhesive layer in one embodiment of this invention, fading or discoloring is secured and the formation of uneven coloring can be prevented. Accordingly, by observing the faded state or the discolored state of the display sheet, the integrated lighting time or the life of the lamp can be notified beforehand and also the time for renewing the lamp can be accurately determined.

While the invention has been described in detail and with reference to specific embodiments thereof, it will be apparent to one skilled in the art that various changes and modifications can be made therein without departing from the spirit and scope thereof.

What is claimed is:

1. A lighting lamp comprising a lamp having laminated on the surface of a bulb thereof a display sheet, said display sheet comprising a support having thereon an active layer containing a pigment which is faded by the action of an active light and an active light-adjusting layer.

2. A lighting lamp as in claim 1, wherein said active layer is located closer to the bulb than said active light-adjusting layer.

3. A lighting lamp as in claim 1, wherein said active light-adjusting layer is located closer to the bulb than said active layer.

4. A lighting lamp as in claim 2, wherein said active layer is laminated on the surface of the bulb through an adhesive layer such that at least the display portion of said active layer is exposed to air.

5. A lighting lamp as in claim 3, wherein said active light-adjusting layer is laminated on the surface of the bulb through an adhesive layer such that at least the display portion of said active light-adjusting layer is exposed to air.

6. A lighting lamp as in claim 1, wherein said active light-adjusting layer also functions as the support.

7. A lighting lamp as in claim 2, wherein said active light-adjusting layer also functions as the support.

8. A lighting lamp as in claim 3, wherein said active light-adjusting layer also functions as the support.

9. A lighting lamp as in claim 4, wherein said active light-adjusting layer also functions as the support.

10. A lighting lamp as in claim 5, wherein said active light-adjusting layer also functions as the support.

11. A lighting lamp as in claim 1, wherein said pigment which is faded by the action of an active light is a monoazo pigment, a disazo pigment, a diphenylmethane pigment, a triphenylmethane pigment, a quinone pigment, or a metal complex salt pigment.

12. A lighting lamp as in claim 1, wherein said active light-adjusting layer is a layer containing a composition which is absorptive to the active light.

13. A lighting lamp as in claim 4, wherein said adhesive layer is formed by applying a coating solution containing at least one adhesive selected from a natural rubber adhesive, an SBR adhesive, an acrylic adhesive, a butyl rubber adhesive, a thermoplastic elastomer adhesive, a silicone adhesive, a vinyl acetate adhesive, a vinyl chloride adhesive, an epoxy adhesive, a polyamide adhesive, an EVA adhesive, a urethane adhesive, a denatured acrylic adhesive, and an acrylate-vinyl acetate adhesive.

14. A lighting lamp as in claim 5, wherein said adhesive layer is formed by applying a coating solution containing at least one adhesive selected from a natural rubber adhesive, an SBR adhesive, an acrylic adhesive, a butyl rubber adhesive, a thermoplastic elastomer adhesive, a silicone adhesive, a vinyl acetate adhesive, a vinyl chloride adhesive, an epoxy adhesive, a polyamide adhesive, an EVA adhesive, a urethane adhesive, a denatured acrylic adhesive, and an acrylate-vinyl acetate adhesive.

* * * * *